US005289203A

United States Patent [19]

Takeuchi

[11] Patent Number: 5,289,203

[45] Date of Patent: Feb. 22, 1994

[54] THERMAL HEAD

[75] Inventor: Noriyasu Takeuchi, Kawasaki, Japan

[73] Assignee: Ricoh Company, Ltd., Tokyo, Japan

[21] Appl. No.: 820,279

[22] Filed: Jan. 14, 1992

[30] Foreign Application Priority Data

Jan. 22, 1991 [JP] Japan ..... 3-021576

[51] Int. Cl.[5] ..... B41J 2/325

[52] U.S. Cl. ..... 346/76 PH

[58] Field of Search ..... 346/76 PH

[56] References Cited

U.S. PATENT DOCUMENTS 4,970,530 11/1990 Takeda ..... 346/76 PH

FOREIGN PATENT DOCUMENTS 53-87240 8/1978 Japan ..... B41M 5/20
0056570 4/1985 Japan ..... 346/76 PH
0164854 7/1986 Japan ..... 346/76 PH
0108071 5/1987 Japan ..... 346/76 PH

*Primary Examiner*—Benjamin R. Fuller
*Assistant Examiner*—Huan Tran
*Attorney, Agent, or Firm*—Cooper & Dunham

[57] ABSTRACT

A thermal head comprising a plurality of heating resistor elements disposed in a row. Each of the resistor element has a rectangular window formed in a center portion of the element. A slit is formed in the resistor element along a direction perpendicular to the row traversing the window and dividing the element to two halves along the direction of the row.

6 Claims, 3 Drawing Sheets

THERMAL HEAD

BACKGROUND OF THE INVENTION

1. Field of the Invention

The present invention relates to a thermal head which is applicable to a thermal printer.

2. Description of the Related Art

Various kinds of thermal head are known which thermal head utilizes Joule heat obtained by applying electric current to a resistor element.

One of the known kinds of thermal head comprises a plurality of heat generative elements which are disposed in a line on which a printing medium such as an ink sheet and a medium to be printed such as a transfer paper (print paper) are arranged so that by selectively applying current signal to the heating elements so as to generate heat, a part of the ink sheet is molten or sublimed by the heat so that the ink of the sheet is transferred to the print paper surface, as disclosed in Japanese Patent Application Laying Open (KOKAI) No.53-87240.

The technique disclosed in the patent document is aiming at reducing the interval between dots formed by the heating elements.

Another kind of thermal head comprising the heating elements which is not publicly known and aiming at different points is proposed which is arranged as mentioned below.

That is, the proposed thermal head arrangement is based on a stand point that to change the recording density of one dot, it is better to arrange a plurality of heat concentrating portions instead of an even heat distribution over an entire area of the thermal head. For this purpose, a rectangular window is opened in the center of the heating element so that heat is concentrated to be generated at the four corners of the rectangular window which is shaped in a form which also enables to make the dot genuine circular as possible.

More precisely, an electrically insulating layer such as a glazed layer is formed on a substrate which is elongated along the direction X which is perpendicular to the direction Y to which the ink sheet and the print paper are fed and conveyed. A plurality of strip shaped heating resistor elements are disposed over the insulation layer covering the layer. On each of the heating resistor layers, a common electrode and an independent electrode are formed on both sides of the strip of the resistor facing together forming a predetermined gap between the electrodes to form a resistor element in the center portion of the resistor layer between the electrodes. Further, a rectangular window is formed open in the center of the heating element formed in the space between the electrodes.

In accordance with the structure of the thermal head mentioned above, at the time when the printing operation is conducted, heat is concentrated to be generated at four corners of the rectangular window.

There are two ink transfer modes, i.e., printing modes, for operating the thermal head. A first mode is to transfer ink in such a way that in a state wherein the ink sheet and the print paper which were conveyed in the direction Y along the strips of heating elements are stopped and being stationary, an electric current signal is selectively applied to the heating resistor elements so as to generate heat therefrom so that a part of the ink sheet is molten or sublimed so that the ink is transferred to the print paper surface.

A second mode is to transfer ink in such a way that in a state wherein both or one of the ink sheet and the print paper is being conveyed in the direction Y along the strip of heating resistor layer, an electric current signal is selectively applied to the heating resistor elements so as to generate heat therefrom so that a part of the ink sheet is molten or sublimed so that the ink is transferred to the print paper surface.

In the case where the first mode is to be adopted, to obtain a dot of genuine circle, the four sides of the rectangular window are arranged equal to each other. While in the case where the second mode is to be adopted, for the same reason, the sides of the window in the direction Y is shorter than that in the direction X.

However, in accordance with either of the first and second modes, an excessive heat concentration phenomenon occurs at the heat concentrating portions at the four corners of the window. The extent of the heat concentration depends on the difference of the resistance value of the resistor between the portion where the window is formed and the portion where the window is not formed, that is, the ratio of the width along the direction X along which the heating elements are arranged.

More precisely, in the temperature distribution on the print paper in a section thereof along a line in the direction X including the two corners adjacent together in the direction X, there are some portions where the temperature exceeds a critical temperature Tc at which the print paper is molten as a result of which the printing quality is degraded.

To cope with this problem, for example, to adjust the ratio of the width of the window in the direction X as mentioned before, the width (a) of the window in the direction X has to be shortened so that assuming that $a<c/2$ wherein (c) represents the pitch of the heating resistor elements, the gap between the adjacent dots becomes too wide, which causes to form stripes of direction Y in the print paper.

SUMMARY OF THE INVENTION

It is therefore an object of the present invention to provide a thermal head which makes it possible to avoid the excessive heat concentration and raise the printing quality without adversely affecting the circular shape of the dot and generating the stripes in the printed image on the paper.

The above mentioned object of the present invention can be achieved by.

a thermal head comprising a plurality of heating resistor elements disposed in a row, each of the resistor element having a rectangular window formed in a center portion of the element, a slit being formed in the resistor element along a direction perpendicular to the row traversing the window and dividing the element to two halves along the direction of the row.

An advantage of the above mentioned structure of the thermal head in accordance with the present invention that it becomes possible to avoid the excessive heat concentration and raise the print quality without deforming the genuine circle of dot and forming stripes in the printed image on the paper, since the excessive heat concentration can be avoided by the arrangement of the slit.

Further objects and advantages of the present invention will be apparent from the following description of the preferred embodiments of the invention as illustrated in the accompanying drawings.

DESCRIPTION OF THE PREFERRED EMBODIMENTS

Figure 1:
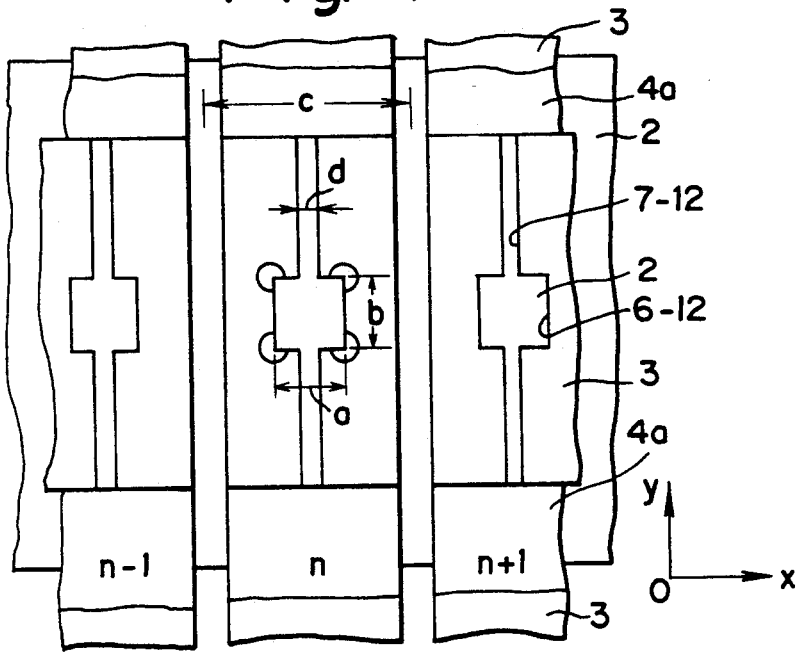
FIG. 1 is an enlarged view of a main portion of the thermal head in accordance with an embodiment of the present invention.

Embodiments of the present invention are described hereinafter with reference to the drawings in detail in comparison to the related art which is also described referring to the drawings.

Figure 5A:
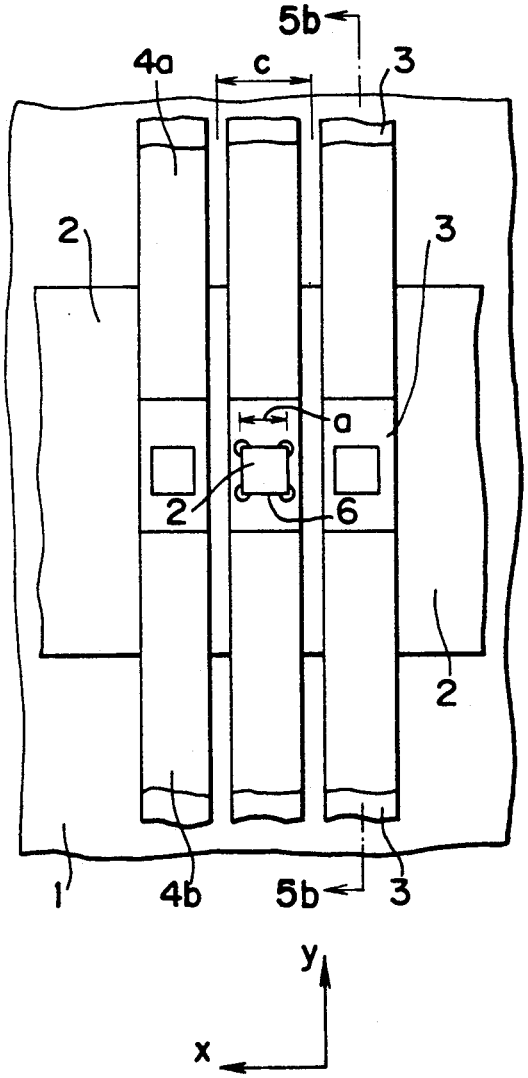
FIG. 5*a* is a plan view of a main portion of the thermal head in accordance with the related art.
Figure 5B:
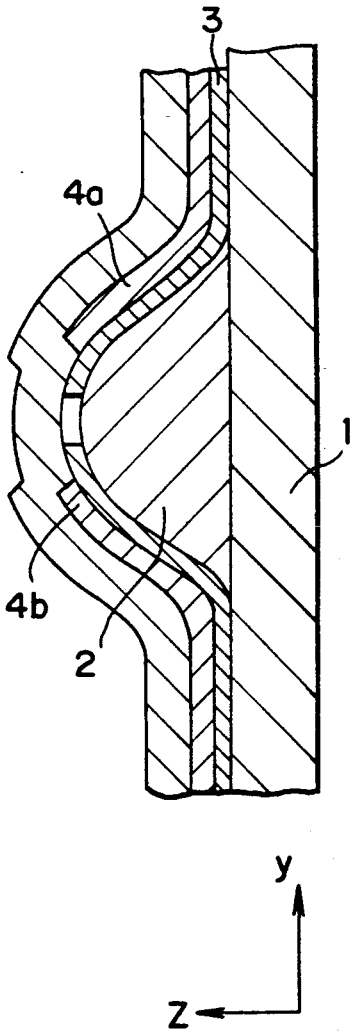
FIG. 5*b* is a sectional view of the main portion of the thermal head of FIG. 5*a*.

FIGS. 5*a* and 5*b* are a plan view and a sectional view of an example of the thermal head in accordance with the related art.

More precisely, with reference to FIGS. 5*a* and 5*b*, an electrically insulating layer 2 such as a glazed layer is formed on a substrate 1 which is elongated along the direction X which is perpendicular to the direction Y to which the ink sheet and the print paper are fed and conveyed. A plurality of strip shaped heating resistor elements 3 are disposed over the insulation layer 2 covering the layer. On each of the heating resistor layers, a common electrode 4*a* and an independent electrode 4*b* are formed on both sides of the strip of the resistor 3 facing together forming a predetermined gap between the electrodes to form a heating portion of the resistor element in the center portion of the resistor layer between the electrodes 4*a* and 4*b*. Further, a rectangular window 6 is formed open in the center of the heating element 3 formed in the space between the electrodes 4*a* and 4*b*.

In accordance with the structure of the thermal head mentioned above, at the time when the printing operation is conducted, heat is concentrated to be generated at four corners of the rectangular window 6, as illustrated by four circles with hatching lines therein.

There are two ink transfer modes, i.e., printing modes, for operating the thermal head. A first mode is to transfer ink in such a way that in a state wherein the ink sheet and the print paper which were conveyed in the direction Y along the strips of heating elements are stopped and being stationary, an electric current signal is selectively applied to the heating resistor elements so as to generate heat therefrom so that a part of the ink sheet is molten or sublimed so that the ink is transferred to the print paper surface.

A second mode is to transfer ink in such a way that in a state wherein both or one of the ink sheet and the print paper is being conveyed and moving in the direction Y along the strip of heating resistor layer, an electric current signal is selectively applied to the heating resistor elements so as to generate heat therefrom so that a part of the ink sheet is molten or sublimed so that the ink is transferred to the print paper surface.

Figure 2A:
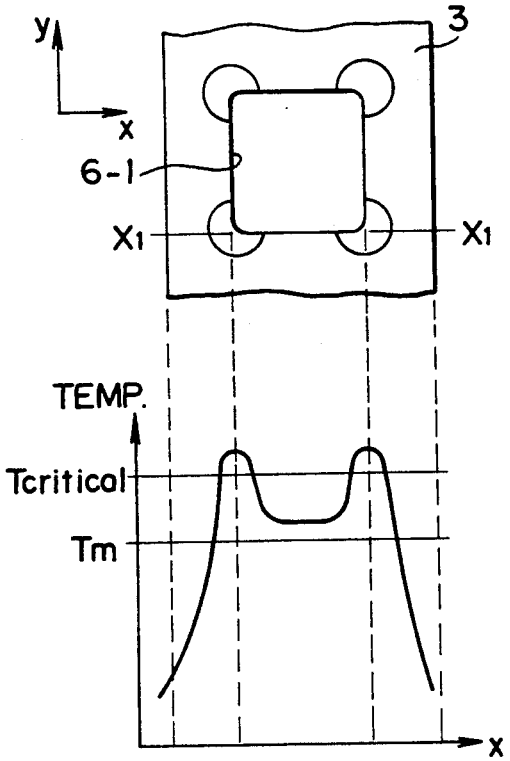
FIG. 2*a* is an explanatory view of the temperature characteristic of the thermal head in accordance with the related art representing the temperature distribution along a section of the window portion of the thermal head.

In the case where the first mode is to be adopted, to obtain a dot of genuine circle, the four sides of the rectangular window are arranged equal to each other, as illustrated by 6-1 in FIG. 2*a*. While in the case where the second mode is to be adopted, for the same reason, the sides of the window in the direction Y is shorter than that in the direction X, as illustrated by 6-2 in FIG. 4*a*.

However, in accordance with either of the first and second modes, an excessive heat concentration phenomenon occurs at the heat concentrating portions at the four corners of the window. The extent of the heat concentration depends on the difference of the resistance value of the resistor between the portion where the window is formed and the portion where the window is not formed, that is, the ratio of the width along the direction X along which the heating elements are arranged.

Figure 4A:
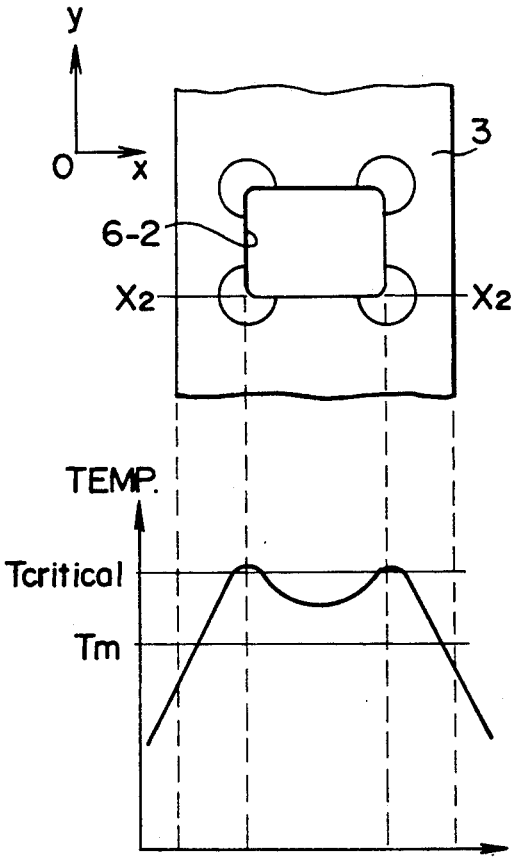
FIG. 4*a* is an explanatory view of the temperature characteristic of the thermal head in accordance with the related art representing the temperature distribution along a section of the window portion of the thermal head.

More precisely, in the temperature distribution on the print paper in a section thereof along a line in the direction X including the two corners adjacent together in the direction X, that is, a section along the line X1—X1 in FIG. 2*a* and a section along the line X2—X2 in FIG. 4*a*, there are portions where the temperature exceeds a critical temperature Tc at which the print paper is molten as a result of which the printing quality is degraded.

To cope with this problem, for example, to adjust the ratio of the width of the window in the direction X as mentioned before, the width (a) of the window in the direction X has to be shortened so that assuming that $a<c/2$ wherein (c) represents the pitch of the heating resistor elements, the gap between the adjacent dots becomes too wide, which causes to form stripes of direction Y in the print paper.

The embodiments of the present invention described below obviate the above mentioned problems so that the excessive heat concentration is avoided and the print quality is upgraded without deforming the genuine circle of dot and generating stripes in the printed image on the paper.

A first embodiment of the present invention is described in detail below with reference to FIG. 1 and FIG. 2*b*. This embodiment is differed from the structure of FIGS. 5*a* and 5*b* in that a slit is formed in the heating resistor structure and the formation of the window is featured as well as other points particularly described below.

In FIG. 1, a rectangular window 6-12 is formed in the center of each heating resistor element 3. The corners of the window 6-12 may be rounded with an appropriate curvature R instead of being formed in right angle. The heating resistor element 3 may be made from $Ta_2N_3$ or $TaSiO_2$.

Figure 2B:
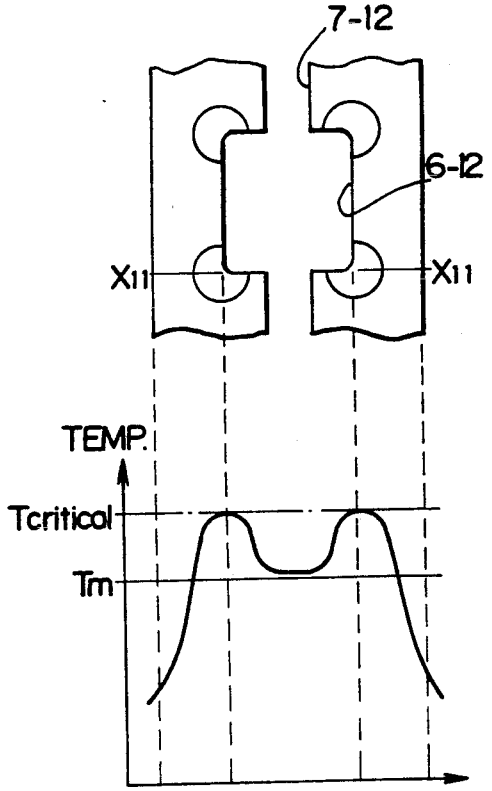
FIG. 2*b* is an explanatory view of the temperature characteristic of the thermal head in accordance with the present invention representing the temperature distribution along a section of the window portion of the thermal head.

In this embodiment, as illustrated in FIGS. 1 and 2*b*, a slit 7-12 is formed in the heating element 3 along the longitudinal center thereof (direction Y) traversing the window 6-12 so that the resistor element is divided to two halves with respect to the direction X along which the elements are disposed.

In accordance with such an arrangement of slit, it becomes possible to reduce the ratio of width in the direction X, which enables to avoid an excessive heat concentration.

In accordance with the related art structure illustrated in FIG. 2*a*, heat generation is excessively concentrated at each corner of the window, so that the temperature at the heat concentrating portion exceeds the critical temperature Tc, which melts the printing paper and causes the degradation of the printing quality including the gloss quality. However, such a problem can be obviated by the arrangement of the slit formed in the resistor element according to the present invention, as can be seen in FIG. 2*b* which shows that there are no portions in the temperature distribution where the temperature exceeds the critical level.

In FIG. 2*b*, the area where the temperature exceeds the transfer start temperature Tm constitutes the portion to form a dot on the printing paper. It is desirable that the ratio of the length in the direction X and the direction Y be approximately 1 so as to obtain a high quality image with the use of the dots formed by the above mentioned arrangement.

Therefore, in the case wherein the ink is transferred to the printing paper in the state where the ink sheet and the paper are being stationary, it is desirable that the relation between the window width (a) in the direction X along which the resistor elements are disposed and the window width (b) in the direction Y along which the ink sheet and the printing paper are conveyed be represented as $a \approx b$ so that a dot of almost genuine circle can be obtained by the heat diffusion.

Also, with respect to the slit length (d), the temperature distribution becomes gentle according as the slit width becomes wide. However, if the slit width becomes too wide, the heat concentration effect at the corners of the window outstanding from the other portions can not be obtained so that the dot becomes a longitudinal ellipse elongated in the direction Y since the shape of the dot depends not only on the position of the heat concentration but also on the shape of the resistor element itself as well. Therefore, it becomes necessary to arrange the relation between the slit width (d) and the window width (a) in the direction X as $d < a/2$.

Also, it is desirable to arrange the pitch (c) of the heating resistor elements disposed in a row as $a \approx c/2$ so as to avoid unevenness of printing density in the direction Y at the time of printing black all over the printing portion with the use of all of dots, as mentioned before.

In accordance with the first embodiment of the present invention mentioned above, a slit is formed in the window formed in each of heating resistor elements which slit divides the element to two halves along the direction of row of elements, which makes it possible to avoid the excessive heat concentration and degradation of printing quality due to melting of the print paper. Also, by selecting an appropriate shape of the window, it becomes possible to form a dot of nearly genuine circle and avoid unevenness of print image.

Figure 3:
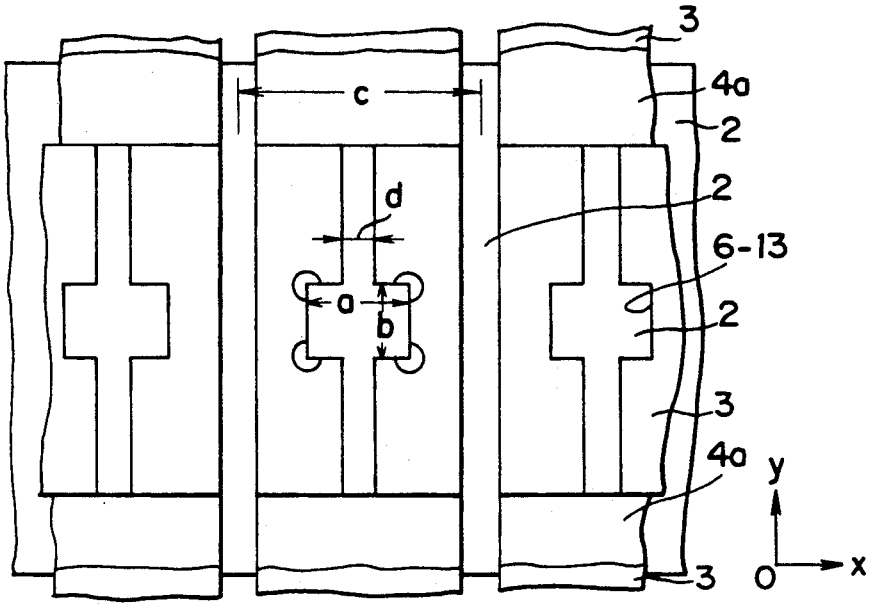
FIG. 3 is an enlarged view of a main portion of the thermal head in accordance with another embodiment of the present invention.

A second embodiment of the present invention is described hereinafter with reference to FIG. 3 and FIG. 4*b*.

The second embodiment is differs from the structure of FIG. 5 of the related art in that a slit is formed in the resistor element and the shape of the window is featured as well as the other points particularly described below.

In this embodiment also as the first embodiment mentioned above, a slit 7-13 is formed in each heating element 3 along the direction Y traversing the window 6-13 and dividing the element 3 to two halves along the direction X along which the elements are disposed.

By arranging such a slit in the heating element, it becomes possible to reduce the ratio of the widow length in the direction X mentioned above so that the excessive heat concentration can be avoided.

In accordance with the related art structure illustrated in FIG. 4*a*, heat generation is excessively concentrated at each corner of the window, so that the temperature at the heat concentrating portion exceeds the critical temperature Tc, which melts the printing paper and causes the degradation of the printing quality including the gloss quality. However, such a problem can be obviated by the arrangement of the slit formed in the resistor element according to the present invention, as can be seen in FIG. 2*b* which shows that there are no portions in the temperature distribution where the temperature exceeds the critical level.

Figure 4B:
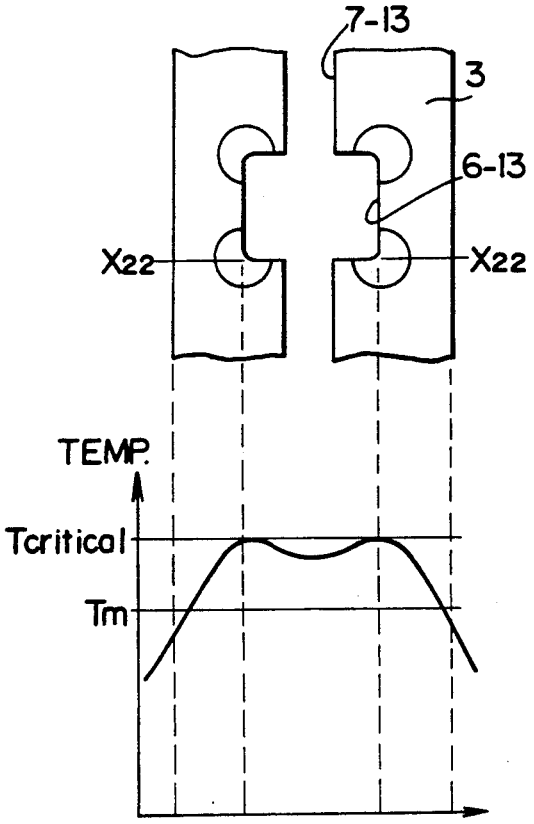
FIG. 4*b* is an explanatory view of the temperature characteristic of the thermal head in accordance with the present invention representing the temperature distribution along a section of the window portion of the thermal head.

In FIG. 4*b*, the area where the temperature exceeds the transfer start temperature Tm constitutes the portion to form a dot on the printing paper. It is desirable that the ratio of the length in the direction X and the direction Y be approximately 1 so as to obtain a high quality print image with the use of the dots formed by the above mentioned arrangement.

Therefore, in the case wherein the ink is transferred to the printing paper in the state where the ink sheet and the paper are being moved, it is desirable that the relation between the window width (a) in the direction X along which the resistor elements are disposed and the window width (b) in the direction Y along which the ink sheet and the printing paper are conveyed be represented as $a > b$ in response to the conveying speed of the ink sheet and the print paper so that a dot of almost genuine circle can be obtained.

Also, with respect to the slit length (d), the temperature distribution becomes gentle according as the slit width becomes wide. However, if the slit width becomes too wide, the heat concentration effect at the corners of the window outstanding from the other portions can not be obtained so that the dot becomes a longitudinal ellipse elongated in the direction Y since the shape of the dot depends not only on the position of the heat concentration but also on the shape of the resistor element itself as well. Therefore, it becomes necessary to arrange the relation between the slit width (d) and the window width (a) in the direction X as $d < a/2$.

Also, it is desirable to arrange the pitch (c) of the heating resistor elements disposed in a row as $a \approx c/2$ so as to avoid unevenness of printing density in the direction Y at the time of printing black all over the printing portion with the use of all of dots, as mentioned before.

In accordance with the second embodiment of the present invention mentioned above, a slit is formed in the window formed in each of heating resistor elements which slit divides the element to two halves along the direction of row of elements, which makes it possible to avoid the excessive heat concentration and degradation of printing quality due to melting of the print paper. Also, by selecting an appropriate shape of the window, it becomes possible to form a dot of nearly genuine circle and avoid unevenness of print image.

Many widely different embodiments of the present invention may be constructed without departing from the spirit and scope of the present invention. It should be understood that the present invention is not limited to the specific embodiments described in the specification, except as defined in the appended claims.

What is claimed is:

1. A thermal head comprising a plurality of heating resistor elements disposed in a row, each of said resistor elements having a rectangular window formed in a center portion thereof, a slit being formed in each of said resistor elements along a direction perpendicular to said row traversing said window and dividing each of said resistor elements into two halves along the direction of said row.

2. A thermal head according to claim 1, wherein each of said heating resistor elements has a strip shape having a longitudinal direction along which an ink medium and a print medium to which the ink is to be transferred are conveyed.

3. A thermal head according to claim 2, wherein each of said windows has a square shape so that said ink is transferred to said print medium in a state where said ink medium and said print medium are both stationary.

4. A thermal head according to claim 2, wherein each of said windows has a rectangular shape elongated in the direction of said row of resistor elements so that said ink is transferred to said print medium in a state where said ink medium and/or said print medium is being moved.

5. A thermal head according to claim 3, wherein the relation between a width (a) of said window in the direction of said row of resistor elements, a width (b) of said window in the direction perpendicular to said row of resistor elements, a pitch (c) of said resistor elements and a width (d) of said slit in the direction of said row of said resistor elements is represented as follows:

$$a \approx b \approx c/2 \text{ and } d < a/2.$$

6. A thermal head according to claim 4, wherein the relation between a width (a) of said window in the direction of said row of resistor elements, a width (b) of said window in the direction perpendicular to said row of resistor elements, a pitch (c) of said resistor elements and a width (d) of said slit in the direction of said row of said resistor elements is represented as follows:

$$a \approx c/2 \text{ and } b < a \text{ and } d < a/2.$$

* * * * *